US010249228B2

(12) United States Patent
Han

(10) Patent No.: US 10,249,228 B2
(45) Date of Patent: Apr. 2, 2019

(54) APPARATUS AND METHOD FOR ADJUSTING COLOR OF DISPLAY APPARATUS

(71) Applicant: Dongbu HiTek Co. Ltd., Bucheon-si (KR)

(72) Inventor: Yong In Han, Cupertino, CA (US)

(73) Assignee: DB HiTek Co., Ltd., Seoul (KR)

( * ) Notice: Subject to any disclaimer, the term of this patent is extended or adjusted under 35 U.S.C. 154(b) by 216 days.

(21) Appl. No.: 15/360,728

(22) Filed: Nov. 23, 2016

(65) Prior Publication Data

US 2017/0256195 A1 Sep. 7, 2017

(30) Foreign Application Priority Data

Mar. 2, 2016 (KR) ..... 10-2016-0024983

(51) Int. Cl.
*G09G 5/00* (2006.01)
*G09G 3/20* (2006.01)

(52) U.S. Cl.
CPC ..... *G09G 3/2011* (2013.01); *G09G 3/2003* (2013.01); *G09G 2320/0666* (2013.01)

(58) Field of Classification Search
CPC ..... G09G 2320/0666; G09G 3/2003; G09G 3/2011
See application file for complete search history.

(56) References Cited

U.S. PATENT DOCUMENTS

2013/0222414 A1* 8/2013 Ito ..... G09G 5/02 345/600
2016/0035286 A1* 2/2016 Kawaguchi ..... G09G 3/3406 345/212

* cited by examiner

*Primary Examiner* — Insa Sadio
(74) *Attorney, Agent, or Firm* — Andrew D. Fortney; Central California IP Group, P.C.

(57) ABSTRACT

A display apparatus is disclosed. The display apparatus includes a converter configured to convert image pixel values corresponding to three primary colors (e.g., red, green and blue) into tri-stimulus values, a first maximum value unit configured to output a maximum value of the image pixel values as a first maximum value, a second maximum value unit configured to output a maximum value of the tri-stimulus values as a second maximum value, a gain adjuster configured to output a gain adjustment corresponding to the first maximum value and the second maximum value, and a gain applier configured to output a color adjustment value corresponding to the tri-stimulus values and the gain adjustment.

20 Claims, 4 Drawing Sheets

APPARATUS AND METHOD FOR ADJUSTING COLOR OF DISPLAY APPARATUS

CROSS REFERENCE TO RELATED APPLICATION

This application claims priority to and the benefit of Korean Patent Application No. 10-2016-0024983, filed on Mar. 2, 2016 in the Korean Intellectual Property Office, the disclosure of which is hereby incorporated by reference in its entirety as if fully set forth herein.

BACKGROUND OF THE INVENTION

Field of the Invention

The present invention relates to a method and apparatus for adjusting color in a display apparatus, and more particularly, to a method and apparatus for receiving a signal for determining a hue of an image and then adjusting a received hue signal to display the signal in the display apparatus.

Discussion of the Related Art

In the multimedia age, the demands for effectively displaying various forms of information are on the rise, and having an effective display as a visual information display device becomes very important. Color is an element that effectively transmits information in most information displays, as well as in a television (TV). Reproduction of pleasant and satisfactory color is an important quality and/or performance criterion of a display with regard to human sensitivity or preferences.

Color is sensed or visually felt by human beings through light. It is known that it is difficult to quantize or objectively measure color. However, through experiments of classifying numerous surrounding colors, it may be seen that color has three sensory attributes (e.g., hue, brightness, and saturation). Research into color measurement technologies and visual information has been developed to a level providing a design tool for optimum color reproduction performance in consideration of an observer and an observation condition, as well as a display system.

With regard to color perception of human beings, many models may exist. For example, one model is the Trichromatic Theory of Helmholtz. Another model is the International Commission on Illumination (CIE) that makes quantitative and anthropometric tools, such as a color matching function and a uniform color space. Many experiments have been performed using the standard color observer, such as the three-color corresponding functions $\bar{x}(\lambda)$, $\bar{y}(\lambda)$, and $\bar{z}(\lambda)$, as defined by CIE.

A display device receives an electrical signal converted according to the perceived color and the display's original color. Color gamut refers to a range of colors that are displayed in a graphic screen of a computer. Generally, the color gamut is an indicator or a reference for determining how close a color is expressed to its actual natural color. In addition, in order to obtain a smooth color without color distortion or agglomeration, a display device may change the saturation, the hue, etc., of a color image to enhance expressiveness. There is a need to overcome a problem that the hues of pixels at a boundary of an expression range of effective data are changed during a procedure for enhancing expressiveness of a display device.

SUMMARY OF THE INVENTION

Accordingly, the present invention is directed to an apparatus and method for adjusting color in a display apparatus that substantially obviates one or more problems due to limitations and disadvantages of the related art.

An object of the present invention is to provide a method and apparatus for adjusting a color image signal to maintain the hue and the data continuity and enhance color expressiveness of an image, and to prevent the hue from being modified during a conversion procedure of the hue, the saturation, etc., and to smoothly express color.

Another object of the present invention is to provide a method and apparatus for adjusting color, for controlling an effective range of a color space (e.g., not to exceed the effective range) that is naturally expressed during a procedure of adjusting tri-stimulus values in the color space. As a result, hue distortion or aggregation to obtain a natural hue during a procedure of changing saturation, hue, etc., of a color image is prevented. Thus, expressiveness is enhanced.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof, as well as the appended drawings.

To achieve these objects and other advantages and in accordance with the purpose of the invention, as embodied and broadly described herein, a display apparatus may express natural color without hue distortion or aggregation.

In an aspect of the present invention, a display apparatus with a color adjustment function includes a converter configured to convert image pixel values corresponding to three primary colors (e.g., red, green and blue [or RGB]) into tri-stimulus values, a first maximum value unit configured to output a maximum value of the image pixel values as a first maximum value, a second maximum value unit configured to output a maximum value of the tri-stimulus values as a second maximum value, a gain adjuster configured to output a gain adjustment corresponding to the first maximum value and the second maximum value, and a gain applier configured to output a color adjustment value corresponding to the tri-stimulus values and the gain adjustment.

A total gain of the color adjustment value with respect to the image pixel values may be a product of a conversion gain of the converter and the gain adjustment.

The total gain may be in a range of less than or equal to (e.g., up to) 1, the conversion gain, and/or the second maximum value divided by the first maximum value.

When the second maximum value is greater than 0 and less than a reference value that is less than an effective maximum value, the total gain may be the conversion gain and/or the gain adjustment, either or both of which may be 1.

When the second maximum value is greater than or equal to the reference value, the gain adjustment may be the total gain divided by the conversion gain.

In one embodiment, the gain adjustment is Gadj, Cm is the second maximum value, Ci is the first maximum value, Th is the reference value, M is a maximum value of the color adjustment value, and the gain adjustment may be determined according to the equation:

$$G_{adj} = \begin{cases} 1 & \text{, when } Cm < Th \\ \frac{Th}{C_m} + \frac{C_i}{C_m}\left(\frac{C_m M - C_m Th}{C_m M - C_i Th}\right)\left(1 - \frac{Th}{C_m}\right) & \text{, when } Cm \geq Th \end{cases}$$

The total gain may be less than 1.

The total gain may be the conversion gain, and the total gain and/or the conversion gain may be the second maximum value divided by the first maximum value.

The gain adjustment from the gain adjuster may be 1.

The converter may have a function including a 3×3 matrix configured to convert the image pixel values into the tri-stimulus values.

A coefficient of the 3×3 matrix may be a value that is fixed with respect to pixels of an entire screen.

Alternatively, the coefficient of the 3×3 matrix may vary for each pixel according to a preset condition containing a hue and/or may be applied identically to the three primary colors (e.g., RGB) in one image.

In another aspect of the present invention, a method of adjusting one or more colors of a display apparatus includes converting image pixel values corresponding to three primary colors (e.g., red, green and blue) into tri-stimulus values, determining a first maximum value as a maximum value in the image pixel values and a second maximum value as a maximum value in the tri-stimulus values, determining a gain adjustment corresponding to the first maximum value and the second maximum value, and outputting a color adjustment value corresponding to the tri-stimulus values and the gain adjustment.

The total gain of the color adjustment value with respect to the image pixel values may be obtained by multiplying a conversion gain of the converter by the gain adjustment.

The total gain may be in a range of less than or equal to (e.g., up to) 1. Alternatively or additionally, the total gain may be the conversion gain, and the total gain and/or the conversion gain may be obtained by dividing the second maximum value by the first maximum value.

When the second maximum value is greater than 0 and less than a reference value, the reference value may be less than an effective maximum value, the total gain may be the conversion gain, and the gain adjustment may be 1. When the second maximum value is greater than or equal to the reference value, the gain adjustment may be obtained by dividing the total gain by the conversion gain.

When the total gain is less than 1, the total gain may be the same as the conversion gain, the total gain and/or the conversion gain may be obtained by dividing the second maximum value by the first maximum value, and the gain adjustment may be 1.

Converting the image pixel values into the tri-stimulus values may be determined according to a function including a 3×3 matrix of a coefficient that is fixed with respect to pixels of an entire image.

Converting the image pixel values into the tri-stimulus values may vary according to a preset condition containing a hue and/or may be determined according to a function including a 3×3 matrix of a coefficient that is applied identically to the three primary colors in one image.

In another aspect of the present invention, the apparatus is configured to provide color adjustment in a display. The apparatus may include a processing system that comprises at least one data processor and at least one tangible computer-readable memory storing a computer program. Herein, the processing system is configured to cause the apparatus to convert image pixel values corresponding to three primary colors (e.g., red, green and blue, or RGB) into tri-stimulus values; determine a first maximum value as a maximum image pixel value and a second maximum value as a maximum tri-stimulus value; determine a gain adjustment corresponding to the first maximum value and the second maximum value; and output a color adjustment value corresponding to the tri-stimulus values and the gain adjustment.

In another aspect of the present invention, a non-transitory computer readable medium can store a program causing a processing system to execute a process for providing color adjustment in a display. The process includes converting image pixel values corresponding to three primary colors (e.g., red, green and blue) into tri-stimulus values, determining a first maximum value as a maximum value in the image pixel values and a second maximum value as a maximum value in the tri-stimulus values, determining a gain adjustment corresponding to the first maximum value and the second maximum value, and outputting a color adjustment value corresponding to the tri-stimulus values and the gain adjustment.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle(s) of the invention. In the drawings.

DETAILED DESCRIPTION OF THE INVENTION

Reference will now be made in detail to the preferred embodiments of the present invention, examples of which are illustrated in the accompanying drawings. The suffixes "module" and "unit" of elements herein are used for convenience of description, and thus can be used interchangeably and do not have any distinguishable meanings or functions.

In description of elements, it will be understood that when an element is referred to as being "on (above)" or "under (below)" another element, the element can be directly on another element or intervening one or more elements. In addition, the expression "on (above)" or "under (below)" may include the meaning of a lower direction, as well as an upper direction based on one element.

Figure 1:
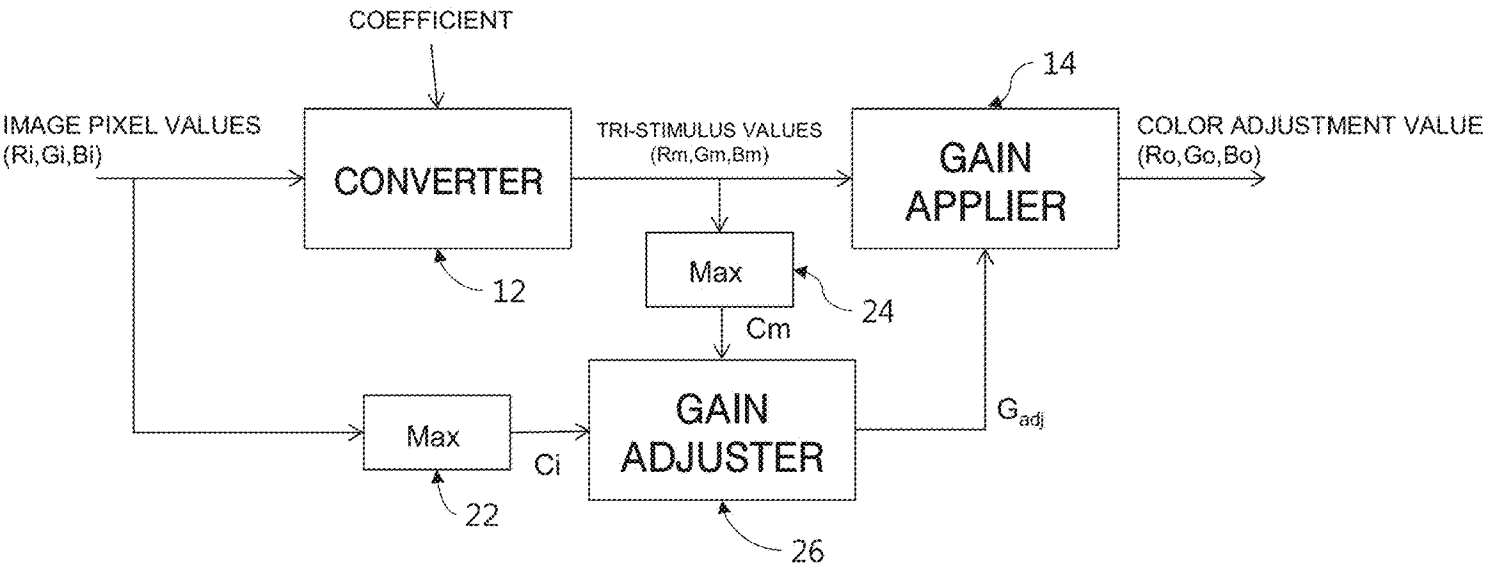
FIG. 1 is a diagram of an exemplary display apparatus with a color adjustment function.

FIG. 1 is a diagram of an exemplary display apparatus with a color adjustment function.

As illustrated in FIG. 1, the display apparatus with a color adjustment function may include a converter 12 configured to convert image pixel values (Ri, Gi, Bi) corresponding to three primary colors (e.g., RGB) into the tri-stimulus values (e.g., Rm, Gm, Bm), a first maximum value unit 22 configured to output a maximum value of the image pixel values (e.g., Ri, Gi, Bi) as a first maximum value Ci, a second maximum value unit 24 configured to output a maximum value of the tri-stimulus values (e.g., Rm, Gm, Bm) as a second maximum value Cm, a gain adjuster 26 configured to output a gain adjustment Gadj corresponding to the first maximum value Ci and the second maximum value Cm, and a gain applier 14 configured to output color adjusted values (e.g., Ro, Go, Bo) corresponding to the tri-stimulus values (e.g., Rm, Gm, Bm) and the gain adjustment Gadj.

For example, the converter 12 may include a function containing a 3×3 matrix for converting the image pixel values (e.g., Ri, Gi, Bi) into the tri-stimulus values (e.g., Rm, Gm, Bm). In some embodiments, a coefficient of a 3×3 matrix may be a fixed value with respect to pixels of an entire screen. Alternatively, the coefficient of the 3×3 matrix may be varied for each pixel according to a preset condition containing hue, but may be applied in the same way (e.g., identically) to each of the three primary colors (e.g., RGB) in one image. For example, the 3×3 matrix included in the converter 12 may be explained with reference to the following equation:

$$\begin{vmatrix} R_m \\ G_m \\ B_m \end{vmatrix} = \begin{vmatrix} X_r & X_g & X_b \\ Y_r & Y_g & Y_b \\ Z_r & Z_g & Z_b \end{vmatrix} * \begin{vmatrix} R_i \\ G_i \\ B_i \end{vmatrix}$$

Here, a coefficient of the converter 12 may be determined according to settings or references for how the color adjusted values (e.g., Ro, Go, Bo) as an output of the gain applier 14 are perceived by a user's eyes in the display apparatus with a color adjustment function. The coefficient of the converter 12 may vary according to the hue. Here, the hue is one of three main attributes (e.g., of color), along with brightness and saturation, and is distinguishably referred to by a color name such as yellow or red, and is commonly represented along with a word for describing brightness and/or saturation, such as light yellow or dark red.

A coefficient of the 3×3 matrix may be determined by various groups or organizations (e.g., European Y'U'V' [EBU], American Y'I'Q', SMPTE-C RGB, ITU.BT-601 Y'CbCr, ITU.BT-709, SMPTE-240M Y'PbPr, and/or Kodak PhotoYCC Colour Space).

The gain adjuster 26 for determination of the gain adjustment Gadj for color adjustment may receive the first maximum value Ci and the second maximum value Cm from the first maximum value unit 22 and the second maximum value unit 24. The first maximum value Ci and the second maximum value Cm may be determined according to the following equations:

$$Ci=\max(Ri,Gi,Bi)$$

$$Cm=\max(Rm,Gm,Bm)$$

A value obtained by dividing the second maximum value Cm by the first maximum value Ci may be considered to be a conversion gain, or a gain of the converter 12. A function of the first maximum value Ci and the second maximum value Cm, for determination of the gain adjustment Gadj determined according to the first maximum value Ci and the second maximum value Cm, may be explained according to the following equation:

$$Gadj=f(Ci,Cm)$$

Here, a function f(Cx, Cy, . . . ) for determination of the gain adjustment Gadj may be an arbitrary nonlinear function, and may include a parameter that is predetermined according to a use of the function.

The gain applier 14 may output the color adjusted values (e.g., Ro, Go, Bo) on which color adjustment is performed according to the tri-stimulus values (e.g., Rm, Gm, Bm) and the gain adjustment Gadj. For example, the gain applier 14 may multiply the tri-stimulus values (e.g., Rm, Gm, Bm) by the gain adjustment Gadj to output the color adjusted values (e.g., Ro, Go, Bo) according to the following equation:

$$\begin{vmatrix} R_o \\ G_o \\ B_o \end{vmatrix} = G_{adj} * \begin{vmatrix} R_m \\ G_m \\ B_m \end{vmatrix}$$

Referring to FIG. 1, in the display apparatus with a color adjustment function, the total gain (e.g., Gtotal) of the color adjusted values (e.g., Ro, Go, Bo) with respect to the image pixel values (e.g., Ri, Gi, Bi) may be determined according to the coefficient of the 3×3 matrix used by the converter 12 and the gain adjustment Gadj used by the gain applier 14.

Figure 2:
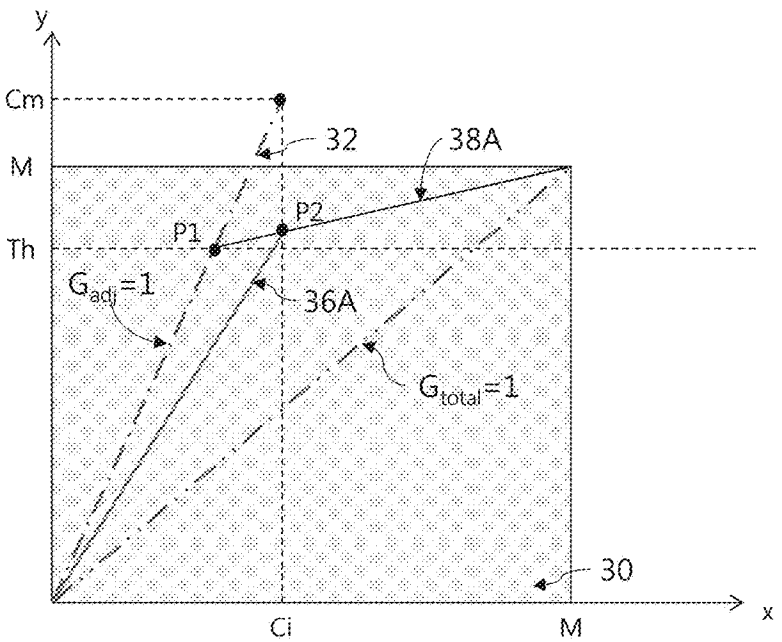
FIG. 2 is a graph for explaining an exemplary first gain determination method.

FIG. 2 is a diagram of an exemplary first gain determination method.

As illustrated in FIG. 2, the gain adjustment Gadj (e.g., refer to FIG. 1 and the discussion thereof above) according to the first gain determination method may be obtained on the assumption that the total gain Gtotal of the color adjusted values (e.g., Ro, Go, Bo) with respect to the image pixel values (e.g., Ri, Gi, Bi) is in a range of less than or equal to 1 (e.g., $0<Gtotal\leq 1$) from a maximum gain 32, which may be obtained by dividing the second maximum value Cm by the first maximum value Ci. Here, the maximum gain 32 may be greater than 1.

Referring to FIG. 2, a color gamut 30 for the color to be displayed by the display apparatus may be present. When a value of one or more of three primary colors (e.g., RGB, but which may also be yellow, cyan and magenta [YCM], etc.) exceeds the color gamut 30, it may be difficult to display the color normally using the display apparatus.

In order to determine the total gain Gtotal and the gain adjustment Gadj, the color gamut 30 may be considered. For example, when the color adjusted values (e.g., Ro, Go, Bo) obtained by applying the gain adjustment Gadj to the tri-stimulus values (e.g., Rm, Gm, Bm) from the converter 12 (e.g., refer to FIG. 1) deviates from the color gamut 30, it may be difficult to display a corresponding color value normally using the display apparatus.

When color adjustment is performed linearly in the color gamut 30, a user may experience an image of a more natural color. To this end, a reference value Th that varies for the purpose of color adjustment, or that is preset and input (e.g., as a constant value), may be separately determined. For example, the reference value Th may be greater than 0 and less than an effective maximum value M.

In detail, FIG. 2 is a diagram of the gain adjustment Gadj used by the gain applier 14 of FIG. 1 from the total gain Gtotal determined by the converter 12 of FIG. 1 (and, in some embodiments, the gain applier 14 of FIG. 1). When the second maximum value Cm is less than the reference value Th, the total gain Gtotal may be a maximum gain (Cm/Ci, the inclination or slope of the line 32). For example, the first maximum value Ci and the second maximum value Cm are positioned on the line 32 for connection between the origin (0, 0) and a point P1. In this case, the gain may be obtained according to the following equation:

$$Gtotal=Cm/Ci$$

In this case, the gain adjustment Gadj determined by the gain adjuster 26 of FIG. 1 may be 1.

When the second maximum value Cm is greater than or equal to the reference value Th, the gain adjustment Gadj may be a value obtained by dividing the total gain Gtotal by the gain of the converter 12 of FIG. 1. The gain adjustment Gadj may be described according to the following equation:

$$Gadj = Gtotal \times Ci/Cm$$

For example, like P2, the first maximum value Ci and the second maximum value Cm are positioned on a line for connection between P1 and a point (M, M). When the first maximum value Ci and the second maximum value Cm are positioned at the point P2, the total gain Gtotal may be equal to an inclination or slope of the line 36 connected between the origin (0, 0) and the point P2. In this case, the gain adjustment Gadj may be explained according to the following equation:

$$G_{adj} = \frac{Th}{C_m} + \frac{C_i}{C_m}\left(\frac{C_m M - C_m Th}{C_m M - C_i Th}\right)\left(1 - \frac{Th}{C_m}\right)$$

A function (e.g., f(Ci, Cm)) according to the aforementioned first gain determination method in the display apparatus with a color adjustment function may be summarized as follows.

The first line 32 may be a straight line connected between an original point (0,0) and (Ci, Cm) in coordinates (x, y). An intersection point between the first line 32 and a straight line of a reference value (e.g., y=Th) may be a first intersection point P1, a straight line between the first intersection point P1 and the maximum values (M, M) of the color gamut 30 may be a second line 38A, an intersection point between the second line 38A and the first maximum value (x=Ci) may be a second intersection point P2, and an inclination or slope of the second intersection point P2 may be the total gain Gtotal.

The same color in the tri-stimulus values (e.g., Rm, Gm, Bm) as an output of the converter 12 of FIG. 1 may be distributed along the first line 32 and may deviate from the color gamut 30, but when the gain adjustment Gadj is adjusted according to the first gain determination method, if the second maximum value Cm is less than the reference value Th, the color adjusted values (e.g., Ro, Go, Bo) may be distributed along the first line 32 and, then, when the second maximum value Cm is greater than or equal to the reference value Th, the color adjusted values (e.g., Ro, Go, Bo) may be distributed along the second line 38A.

Accordingly, the color adjusted values (e.g., Ro, Go, Bo) may always be distributed in the color gamut 30.

The first maximum value Ci illustrated in FIG. 2 may be described using a Chebyshev distance between the image pixel values (e.g., Ri, Gi, Bi) and an original point (0,0,0) and the second maximum value Cm may be described using a Chebyshev distance between the tri-stimulus values (e.g., Rm, Gm, Bm) and the original point (0,0,0). For example, when the image pixel values (e.g., Ri, Gi, Bi) of the first maximum value Ci is x and the original point (0,0,0) is y, the Chebyshev distance may be described as follows:

$$d(x,y) = \max_i |x_i - y_i|$$

As such, when the first maximum value Ci and the second maximum value Cm are described using the respective Chebyshev distances, the gain adjustment Gadj (e.g., refer to FIG. 1) according to the first gain determination method may be determined according to a ratio of the two Chebyshev distances.

When (1) the reference value Th described with reference to FIG. 2 is greater than a maximum value M of the color gamut 30, and (2) the second maximum value Cm of all pixels is equal to or less than the reference value Th, gain adjustment by the gain adjuster 26 of FIG. 1 may not occur. In this case, an output of the converter 12 of FIG. 1 may be the color adjusted values (e.g., Ro, Go, Bo) without further changes. When there is no gain adjustment, some elements of the three primary colors (e.g., RGB) may be saturated (e.g., at the maximum value M of the color gamut 30), and discoloration may occur. In the case of single color, pixels that are to be differently expressed have the same value corresponding to the maximum value M of the color gamut 30. Thus, the color expression of a partial region of an entire image may become the same.

When the reference value Th is lowered, the frequency at which discoloration occurs may be gradually reduced. When the reference value Th reaches the maximum value M, discoloration may not occur because the ratio of the elements of the three primary colors (e.g., RGB) is constant, but color agglomeration may occur because of the same value; that is, a difference in color expression may disappear. Accordingly, when the reference value Th is relatively low, the degree of color aggregation may be alleviated, and the overall brightness may be reduced as the gain of pixels exceeding the reference value Th is reduced. As the reference value Th is lowered, the brightness of an area with abundant color may be reduced. Thus, the reference value Th may be compromised and determined between the brightness of a color region (e.g., a certain or predetermined color region) and the degree of color aggregation.

Figure 3:
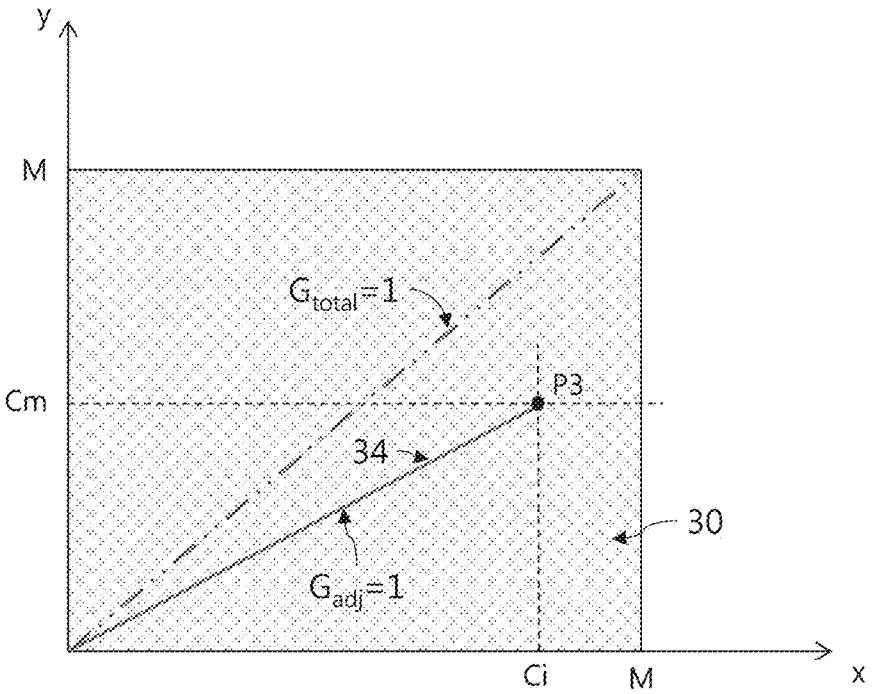
FIG. 3 is a graph for explaining an exemplary second gain determination method.

FIG. 3 is a graph for explaining an exemplary second gain determination method.

As illustrated in FIG. 3, the gain adjustment Gadj (e.g., refer to FIG. 1) according to the second gain determination method may be obtained on the assumption that the total gain Gtotal of the color adjusted values (e.g., Ro, Go, Bo) with respect to the image pixel values (e.g., Ri, Gi, Bi) is included in a range up to a minimum gain 34 obtained by dividing the second maximum value Cm by the first maximum value Ci from 1. Here, the minimum gain 34 may be less than 1.

Referring to FIG. 3, the color gamut 30 for color to be displayed by the display apparatus may be present. When a value of any of three primary colors (e.g., RGB) exceeds the color gamut 30, it may be difficult to display color normally using the display apparatus.

In order to determine the total gain Gtotal and the gain adjustment Gadj, the color gamut 30 may be considered. For example, when the color adjusted values (e.g., Ro, Go, Bo) obtained by applying the gain adjustment Gadj to the tri-stimulus values (e.g., Rm, Gm, Bm) from the converter 12 of FIG. 1 deviate from the color gamut 30, it may be difficult to display a corresponding value normally using the display apparatus.

The image pixel values (e.g., Ri, Gi, Bi) of the three primary colors (e.g., RGB) input to the converter 12 of FIG. 1) may be positioned in the color gamut 30. Accordingly, the first maximum value Ci may not exceed a maximum value M (x axis) of the color gamut 30. When the gain of the converter 12 obtained by dividing the second maximum value Cm by the first maximum value Ci is less than 1, the gain adjustment Gadj output from the gain adjuster 26 of FIG. 1) may be 1. When the gain of the converter 12 is less than 1, the tri-stimulus values (e.g., Rm, Gm, Bm) as an output of the converter 12 may not deviate from (e.g., may be within) the color gamut 30. Thus, the additional gain adjustment through the gain adjuster 26 of FIG. 1) and the gain applier 14 of FIG. 1 may not be required.

When the gain of the converter 12 is less than 1, the gain adjustment Gadj may be 1 and the total gain may be a minimum gain (e.g., Cm/Ci; the inclination of the line 34). For example, the total gain Gtotal may be the inclination of the line 34 for connection between a point P3 and the origin (0, 0) using the first maximum value Ci and the second maximum value Cm.

$$Gtotal=Cm/Ci$$

$$Gadj=1$$

A function (i.e., f(Ci, Cm)) according to the aforementioned second gain determination method in the display apparatus with a color adjustment function may be summarized as follows.

First, the third line 34 may be a straight line for connection between an original point (0,0) and (Ci, Cm) in a coordinate plane (x, y). The inclination or slope of the third line 34 may be the total gain Gtotal.

The first maximum value Ci may not exceed the maximum value M (x axis) of the color gamut 30. Thus, the tri-stimulus values (e.g., Rm, Gm, Bm) as an output of the converter 12 of FIG. 1) may not exceed the color gamut 30. Accordingly, even if the gain applier 14 of FIG. 1 does not correct an additional gain, the color adjusted values (e.g., Ro, Go, Bo) may be distributed in the color gamut 30.

Figure 4:
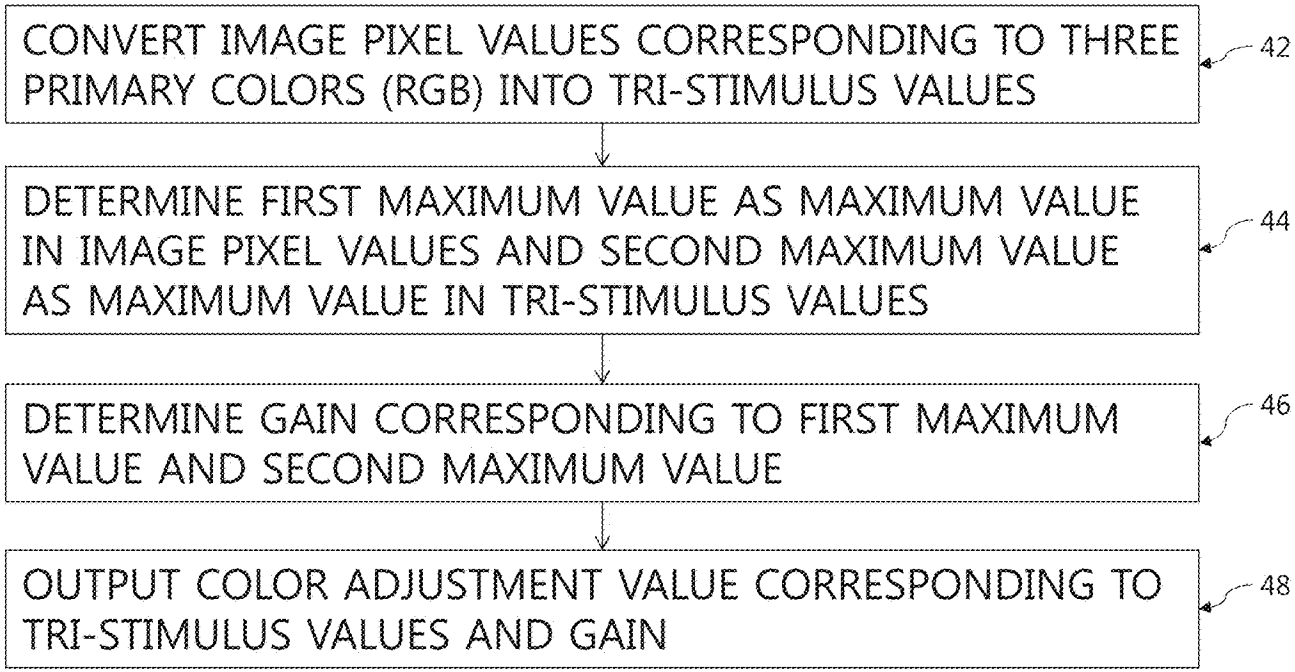
FIG. 4 is a flow chart for an exemplary color adjustment method for a display apparatus.

FIG. 4 is a flow chart for an exemplary method of adjusting color in a display apparatus.

As illustrated in FIG. 4, the method of adjusting color in the display apparatus may include converting an image pixel value corresponding to three primary colors (e.g., RGB) into tri-stimulus values at 42, determining a first maximum value as a maximum value in the image pixel value and a second maximum value as a maximum value in the tri-stimulus values at 44, determining a gain adjustment corresponding to the first maximum value and the second maximum value at 46, and outputting a color adjustment value corresponding to the tri-stimulus values and the gain adjustment at 48.

The total gain during the procedure of controlling the image pixel value into a color adjusted value may be greater than 1. In this case, the total gain may be in a range of greater than 0 but less than or equal to (e.g., up to) 1, from the maximum gain obtained by dividing the second maximum value by the first maximum value.

A reference value for the color adjustment in the color gamut may be greater than 0 and less than an effective maximum value. When the second maximum value is greater than 0 and less than the reference value, the gain adjustment may be 1, and the total gain may be the maximum gain. On the other hand, when the second maximum value is greater than or equal to the reference value, the gain adjustment may be a value obtained by dividing the total gain by the maximum gain.

In addition, the total gain during the procedure of converting an image pixel value into a color adjusted value may be less than 1. The total gain may be the same as the conversion gain (obtained by dividing the second maximum value by the first maximum value) and the gain adjustment corresponding to the first maximum value and the second maximum value.

In some embodiments, conversion into the tri-stimulus values from the image pixel values may be determined according to a function containing a 3×3 matrix of a fixed coefficient with respect to the pixels of the entire screen. In addition, conversion of the tri-stimulus values corresponding to the image pixel values may vary for each pixel according to a preset condition, including a color, but may be determined according to a function including a 3×3 matrix (e.g., of or multiplied by a coefficient) that is applied in the same way to three primary colors (e.g., RGB) in one image.

The method according to the aforementioned embodiments of the present invention may be prepared and/or implemented as a program executable by a computer and stored in a computer-readable recording medium. Examples of the computer-readable recording medium may include, but are not limited to, a read-only memory (ROM), a random-access memory (RAM), a CD-ROM, a magnetic tape, a floppy disc, an optical data storage device, etc. In addition, the computer-readable recording medium may also be embodied in the form of a carrier wave (e.g., a transmission via the Internet).

The computer-readable recording medium may be distributed to one or more computer systems connected through a network, stored and executed as computer-readable code in a distributed manner. In addition, functional programs, codes, and code segments for accomplishing the aforementioned method may be easily construed by programmers skilled in the art to which embodiments of the present invention pertains.

The method and apparatus according to the present invention may have the following advantages.

The present invention may enhance color expressiveness of a display apparatus.

In addition, according to the present invention, the display apparatus may express natural color, thereby enhancing user satisfaction with the display apparatus.

It will be appreciated by persons skilled in the art that that the effects that could be achieved with the present invention are not limited to what has been particularly described hereinabove and other advantages of the present invention will be more clearly understood from the following detailed description taken in conjunction with the accompanying drawings.

Those skilled in the art will appreciate that the present invention may be carried out in ways other than those specifically set forth herein without departing from the spirit and essential characteristics of the present invention.

The above embodiments are therefore to be construed in all aspects as illustrative and not restrictive. The scope of the invention should be determined by the appended claims and their legal equivalents, not by the above description, and all changes coming within the meaning and equivalency range of the appended claims are intended to be embraced therein.

What is claimed is:

1. A display apparatus with a color adjustment function, comprising:

a converter receiving image pixel values corresponding to three primary colors and converting the image pixel values into tri-stimulus values;

a first maximum value unit receiving the image pixel values and outputting a maximum value of the image pixel values as a first maximum value;

a second maximum value unit receiving the tri-stimulus values from the converter and outputting a maximum value of the tri-stimulus values as a second maximum value;

a gain adjuster receiving the first and second maximum values from the first and second maximum value units and outputting a gain adjustment corresponding to the first maximum value and the second maximum value; and a gain applier receiving the tri-stimulus values from the converter and the gain adjustment from the gain adjuster and outputting a color adjustment value corresponding to the tri-stimulus values and the gain adjustment.

2. The display apparatus according to claim 1, wherein a total gain of the color adjustment value with respect to the image pixel values is a product of a conversion gain of the converter and the gain adjustment.

3. The display apparatus according to claim 2, wherein the total gain is in a range of less than or equal to 1 from the conversion gain.

4. The display apparatus according to claim 3, wherein the second maximum value is greater than 0 and less than a reference value, the reference value is less than an effective maximum value, the total gain is the conversion gain, and the gain adjustment is 1.

5. The display apparatus according to claim 4, wherein the second maximum value is greater than or equal to the reference value, and the gain adjustment is the total gain divided by the conversion gain.

6. The display apparatus according to claim 5, wherein the gain adjustment is Gadj, Cm is the second maximum value, Ci is the first maximum value, Th is the reference value, M is a maximum value of the color adjustment value, and the gain adjustment is expressed as:

$$G_{adj} = \begin{cases} 1 & \text{, when } Cm < Th \\ \frac{Th}{C_m} + \frac{C_i}{C_m}\left(\frac{C_m M - C_m Th}{C_m M - C_i Th}\right)\left(1 - \frac{Th}{C_m}\right) & \text{, when } Cm \geq Th \end{cases}.$$

7. The display apparatus according to claim 2, wherein the total gain is less than 1.

8. The display apparatus according to claim 7, wherein the total gain is (i) the conversion gain or (ii) the second maximum value divided by the first maximum value.

9. The display apparatus according to claim 8, wherein the gain adjustment is 1.

10. The display apparatus according to claim 1, wherein the converter has a function comprising a 3×3 matrix configured to convert the image pixel values into the tri-stimulus values.

11. The display apparatus according to claim 10, wherein a coefficient of the 3×3 matrix is a value fixed with respect to pixels of an entire screen.

12. The display apparatus according to claim 10, wherein the coefficient of the 3×3 matrix varies for each pixel according to a preset condition containing a hue.

13. A method of adjusting one or more colors of a display apparatus, the method comprising:

converting image pixel values corresponding to three primary colors into tri-stimulus values;

determining a first maximum value as a maximum value in the image pixel values and a second maximum value as a maximum value in the tri-stimulus values;

determining a gain adjustment corresponding to the first maximum value and the second maximum value; and outputting a color adjustment value corresponding to the tri-stimulus values and the gain adjustment.

14. The method according to claim 13, wherein a total gain of the color adjustment value with respect to the image pixel values is a product of a conversion gain of the converter and the gain adjustment.

15. The method according to claim 14, wherein the total gain is in a range of less than or equal to 1.

16. The method according to claim 15, wherein:

the second maximum value is greater than 0 and less than a reference value, the reference value is less than an effective maximum value, the total gain is the conversion gain, and the gain adjustment is 1; and when the second maximum value is greater than or equal to the reference value, the gain adjustment is the total gain divided by the conversion gain.

17. The method according to claim 14, wherein the total gain is less than 1, the total gain is (i) the conversion gain or (ii) the second maximum value divided by the first maximum value, and the gain adjustment is 1.

18. The method according to claim 13, wherein converting the image pixel values into the tri-stimulus values is determined according to a function comprising a 3×3 matrix of a coefficient that is fixed with respect to pixels of an entire image.

19. The method according to claim 13, wherein converting the image pixel values into the tri-stimulus values varies according to a preset condition containing a hue and is determined according to a function comprising a 3×3 matrix of a coefficient that is applied identically to the three primary colors in one image.

20. An apparatus for adjusting one or more colors in a display device including a processing system that comprises at least one data processor and at least one computer-readable memory storing a computer program, wherein the processing system is configured to cause the apparatus to:

convert image pixel values corresponding to three primary colors into tri-stimulus values;

determine a first maximum value as a maximum value in the image pixel values and a second maximum value as a maximum value in the tri-stimulus values;

determine a gain adjustment corresponding to the first maximum value and the second maximum value; and output a color adjustment value corresponding to the tri-stimulus values and the gain adjustment.

* * * * *